US010738454B2

(12) United States Patent
Spankowski et al.

(10) Patent No.: US 10,738,454 B2
(45) Date of Patent: Aug. 11, 2020

(54) WALL-HUNG TOILET

(71) Applicant: Kohler Co., Kohler, WI (US)

(72) Inventors: Thomas Spankowski, Port Washington, WI (US); Michael Bates, Kohler, WI (US); Rob Davis, Grafton, WI (US); Carl Barlett, Sheboygan, WI (US); John Zutz, Valders, WI (US); Thomas C. Jorsch, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 940 days.

(21) Appl. No.: 14/205,191

(22) Filed: Mar. 11, 2014

(65) Prior Publication Data

US 2014/0259351 A1 Sep. 18, 2014

Related U.S. Application Data

(60) Provisional application No. 61/781,745, filed on Mar. 14, 2013.

(51) Int. Cl.
*E03D 11/14* (2006.01)
*E03D 11/02* (2006.01)

(52) U.S. Cl.
CPC ..... *E03D 11/14* (2013.01); *E03D 11/02* (2013.01)

(58) Field of Classification Search
CPC ..... E03D 1/012; E03D 11/02; E03D 11/08; E03D 11/14; E03D 11/17; E03D 11/146; E03D 9/08; E03D 9/085; F16K 27/12; A47K 3/26
USPC ..... 137/377, 381; 4/252.1–252.4, 253, 312, 4/420.3–420.5, 420, 428, 431, 445, 448, 4/661, 901, 216
See application file for complete search history.

(56) References Cited

U.S. PATENT DOCUMENTS 2,022,265 A * 11/1935 Williams ..... E03D 9/06 248/161
2,066,881 A 1/1937 Groeniger
2,066,882 A 1/1937 Groeniger
(Continued)

FOREIGN PATENT DOCUMENTS

EP 2325402 5/2011
ES WO2011141604 * 11/2011 ..... E03D 9/08
FR 2325402 * 5/2011 ..... E03D 11/02

OTHER PUBLICATIONS

European Search Report dated Sep. 15, 2014 regarding EP Application No. 14159309; 6 pages.

*Primary Examiner* — David P Angwin
*Assistant Examiner* — Nicholas A Ros
(74) *Attorney, Agent, or Firm* — Foley & Lardner LLP

(57) ABSTRACT

A wall-hung toilet including a bowl, a water inlet chamber receiving water, a rim channel, a shroud surrounding at least a portion of the bowl, a rear mount, and a pocket. The rim channel is provided above the bowl and is fluidly connected to the water inlet chamber to receive the water. The rim channel includes an opening that introduces water into a rear portion of the bowl at an angle relative to vertical. The rear mount includes a mounting hole that is configured to connect the toilet to a wall via a fastener engaging the wall and the mounting hole. The pocket is formed in a side of the toilet and extends through the shroud to provide access to an interior side of the mounting hole from the side of the toilet, such that the fastener can be accessed through the pocket from the side of the toilet.

20 Claims, 5 Drawing Sheets

(56) References Cited

U.S. PATENT DOCUMENTS

| | | | | |
|---|---|---|---|---|
| 3,131,402 | A * | 5/1964 | Roberts | E03D 1/266 4/344 |
| 5,097,539 | A * | 3/1992 | Tchorbadjian | E03D 9/08 4/420.4 |
| 5,283,913 | A | 2/1994 | Jaeckels | |
| 5,502,845 | A * | 4/1996 | Hayashi | E03D 11/02 4/300 |
| 6,292,956 | B1 * | 9/2001 | Kayahara | B28B 1/261 4/420 |
| 6,367,095 | B2 * | 4/2002 | Hubatka | E03D 1/22 4/354 |
| D639,406 | S | 6/2011 | Bickerstaffe et al. | |
| 8,321,967 | B2 | 12/2012 | Mesun et al. | |
| D693,910 | S | 11/2013 | Bates et al. | |
| D701,949 | S | 4/2014 | Bates et al. | |
| 2003/0115664 | A1 * | 6/2003 | Kosugi | B28B 1/26 4/420 |
| 2007/0033723 | A1 * | 2/2007 | Fryzer | E03D 9/08 4/420.4 |
| 2012/0210505 | A1 | 8/2012 | Pearson | |

* cited by examiner

WALL-HUNG TOILET

CROSS-REFERENCE TO RELATED PATENT APPLICATIONS

This application claims the benefit of and priority to U.S. Provisional Patent Application No. 61/781,745, which was filed on Mar. 14, 2013. The foregoing U.S. provisional patent application is incorporated by reference herein in its entirety.

BACKGROUND

Modern toilets, such as flush toilets, generally include a bowl which is configured to receive human waste and transport the waste from the bowl to a sewer line. Flush toilets also typically include a tank used to supply fresh water to the bowl for a flushing and rinsing cycle, a trap configured to evacuate waste from the bowl and into the sewer line, and various toilet attachments. Typical toilet attachments may include a seat attachment, a lid attachment, and a bidet attachment.

The water supplied to the bowl of a toilet for a flushing or rinsing cycle may enter the bowl from a series of holes. The holes are generally located along various portions of a rim of the toilet. A typical rim of a toilet may have a bottom wall, which is generally parallel with the floor when the toilet is mounted in an installed state. Also, the bottom wall of the rim is generally positioned above an upper and outer portion of the bowl. The various rim holes of a typical toilet may typically be disposed within the bottom wall of the rim, and a bore of the holes is generally perpendicular to the bottom wall.

SUMMARY

One embodiment disclosed in this application relates to a wall-hung toilet that includes a bowl, a water inlet chamber configured to receive a supply of water, a rim channel, a shroud surrounding at least a portion of the bowl, a rear mount, and a pocket. The rim channel is provided above the bowl and is fluidly connected to the water inlet chamber to receive the supply of water. The rim channel includes an opening that is configured to introduce water into a rear portion of the bowl. The water may be introduced into the rear portion of the bowl at an angle relative to vertical. The rear mount includes a mounting hole that is configured to connect the toilet to a wall via a fastener that is configured to engage the wall and the mounting hole in the rear mount. The pocket is formed in a side of the toilet, such as, for example, between the rear mount and the bowl. The pocket extends through the toilet, such as the shroud, to provide access to an interior side of the mounting hole from the side of the toilet, such that the fastener can be accessed through the pocket from the side of the toilet.

The opening in the rim channel may be provided in a rear portion of a lower member of the rim channel that is adjacent to the water inlet chamber. The lower member of the rim channel may be aligned at an angle that is perpendicular to the angle that the water is introduced into the bowl at. The rim channel may further include a plurality of rim holes in addition to the opening. The plurality of rim holes may be disposed around the rim channel, such as, for example, in a spaced-apart manner. The plurality of rim holes may include rim holes having different sizes. The spacing and the sizing of the rim holes may be configured to swirl the water around the bowl during a flush cycle of the toilet.

The rear mount may further include a clearance hole that extends into the pocket to allow routing of at least one of a water line and an electrical cord into the pocket of the toilet through the clearance hole. The clearance hole may allow routing of both the water line and the electrical cord therethrough.

The wall-hung toilet may further include an accessory hole, which may be provided in a top surface of the toilet. The accessory hole may extend downwardly into the pocket to allow routing of the at least one of the water line and the electrical cord out through the accessory hole from the pocket, such as to connect the water line and/or the electrical cord with an attachment of the toilet. The accessory hole may allow routing of both the water line and the electrical cord therethrough.

The wall-hung toilet may further include an attachment, such as, for example, a bidet attachment accessory. The accessory hole in the top surface of the toilet may be located between a rear surface of the rear mount and the bowl to route the water line and/or the electrical cord to the bidet attachment from the pocket through the accessory hole.

The wall-hung toilet may further include a removable cover that is configured to cover the pocket. An exterior surface of the removable cover may complement an exterior surface of the shroud, such that the cover appears as a continuation of the shroud when the cover is in place covering the pocket.

Another embodiment relates to a wall-hung toilet that includes a bowl, a shroud surrounding at least a portion of the bowl, a rear mount, and a pocket. The rear mount includes a mounting hole and a clearance hole. The mounting hole is configured to connect the toilet to a wall via a fastener that is configured to engage the wall and the mounting hole in the rear mount. The clearance hole is configured to allow routing, such as, for example, of at least one of a water line and an electrical cord to the toilet through the clearance hole. The pocket is formed in a side of the toilet, such as between the rear mount and the bowl. The pocket is configured to provide access to an interior side of the mounting hole and an interior side of the clearance hole from the side of the toilet, such that the fastener, the water line, and/or the electrical cord can be accessed through the pocket from the side of the toilet.

The rear mount may further include a second mounting hole that is configured to connect the toilet to a wall via a second fastener. The second fastener may be configured to engage the wall and the second mounting hole. The two mounting holes may be located on opposing sides of an outlet of a trapway and a water supply hole of the toilet.

The wall-hung toilet may further include a second pocket formed in a second side of the toilet that is opposite the first pocket. The second pocket may provide access to an interior side of the second mounting hole, such that the second fastener can be accessed through the pocket from the second side of the toilet.

The rear mount may further include a second clearance hole, which may be configured to allow routing of a water line and an electrical cord into the second pocket of the toilet through the second clearance hole. For example, one of the water line and the electrical cord may be routed through the first clearance hole, and the other of the water line and the electrical cord may be routed through the second clearance hole.

The wall-hung toilet may further include an accessory hole provided in a top surface of the toilet. The accessory hole may extend downwardly into one of the pockets to allow routing of the water line and/or the electrical cord from the respective pocket through the accessory hole, such as to connect to an attachment of the toilet (e.g., bidet attachment). The accessory hole may be provided in (e.g., pass through) the top surface of the toilet between a rear surface of the rear mount and the bowl.

Yet another embodiment relates to a wall-hung toilet that includes a top surface, a bowl extending downwardly from the top surface, a shroud extending downwardly from the top surface and surrounding at least a portion of the bowl, a rear mounting wall having a mounting hole and a clearance hole, a pocket extending through a side of the shroud between the bowl and rear mounting wall, and an accessory hole extending through the top surface into the pocket. The mounting hole may extend through the rear mounting wall and into the pocket, and the clearance hole may extend through the rear mounting wall and into the pocket.

The wall-hung toilet may further include a second pocket formed in a second side of the shroud opposing the side of the shroud with the first pocket. The rear mounting wall may include a second mounting hole that extends through the rear mounting wall and into the second pocket.

The rear mounting wall may further include a second clearance hole, which may extend through the rear mounting wall into the second pocket. The second clearance hole may be provided on an opposite side of a water supply hole and an outlet of a trapway compared to the first clearance hole in the rear mounting wall.

The wall-hung toilet may further include a rim channel, which may be disposed between the top surface and the bowl. The rim channel may include an opening that is configured to introduce water into a rear portion of the bowl. The opening of the rim channel may be configured to introduce the water into the rear portion of the bowl at an angle relative to vertical.

The wall-hung toilet may further include a water inlet hole that is configured to receive a supply of water from a source (e.g., water source). The water inlet hole may direct the water to the rim channel. The water inlet hole may be defined by at least two stepped sections, and the at least two stepped sections may be configured having decreasing diameters, such as, for example, moving from a rear opening toward the rim channel.

DETAILED DESCRIPTION

Toilets may be mounted in a variety of ways, but generally toilets either mount to a floor, or a wall. Typically, fasteners are used to mount a wall-hung toilet to a wall, and the fasteners are visible from the front or side of the toilet. The fasteners, if visible, detract from the aesthetics and potentially provide cleanliness issues, since they may collect contaminants (e.g., dirt, urine) and may be more difficult to clean.

Certain toilet attachments and other toilet accessories, such as bidets, may include an electrical cord, a water line, or another type of line. When these components are used with a typical toilet, the various lines of the components may extend outside the toilet to an electrical outlet or a water connection along a nearby wall or the floor.

A wall-hung toilet may include a side pocket. If the side pocket for a wall-hung toilet is small, then it difficult for a hand to be received within the pocket. If the pocket is left uncovered (i.e., openly disposed), then the inside of the side pocket remains visible from the side or front of a toilet. It is advantageous to cover the pocket and to have the pocket large enough to fit a hand inside the pocket.

A wall-hung toilet may include an exterior surface proximate the sides and front of the bowl that is convex in curvature. The convex curvature of a wall-hung toilet curves outward toward the floor and the area surrounding a toilet, which may leave less room to clean around the toilet.

The exemplary embodiments of the wall-hung toilets disclosed herein address one or more of the aforementioned issues.

Figure 1:
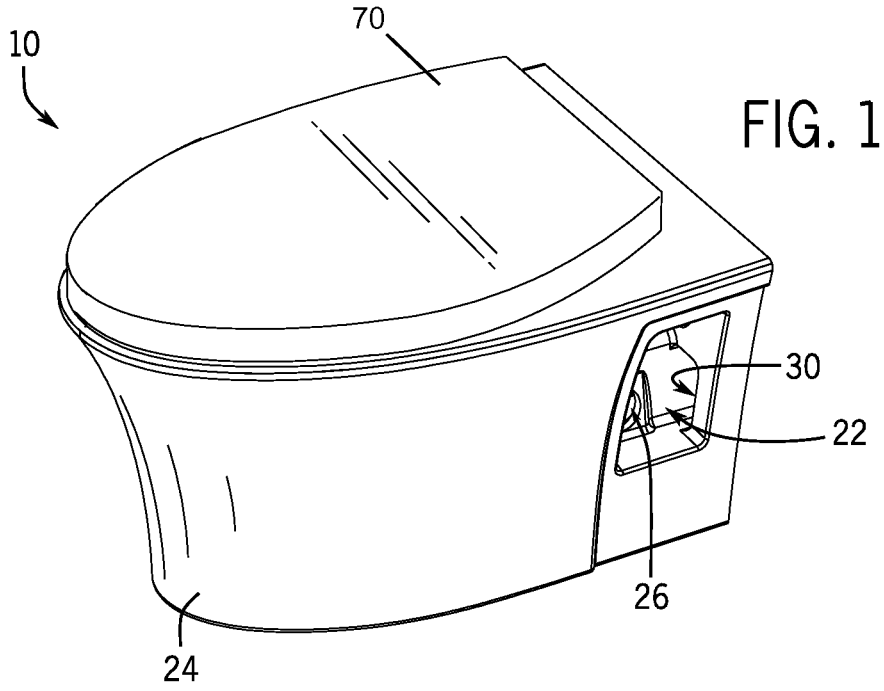
FIG. 1 is a perspective view of a toilet having a lid attachment, according to an exemplary embodiment.
Figure 4:
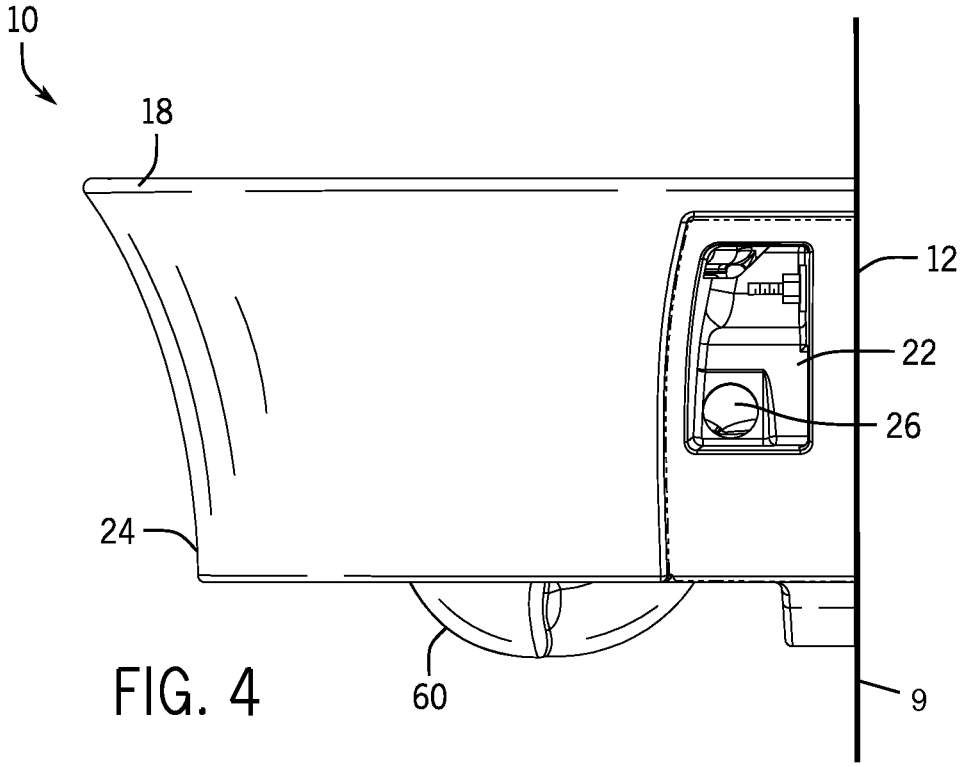
FIG. 4 is a side plan view of the toilet shown in FIG. 3.

FIG. 1 illustrates an exemplary embodiment of a toilet 10, which may be configured as a wall-hung toilet. In other words, the toilet 10 may be configured to mount to a wall, as opposed to resting on the floor. FIG. 4 illustrates the toilet 10 mounted to a vertically extending wall 9. According to various exemplary embodiments, the toilet 10 may be formed from vitreous china, porcelain, stainless steel, or any suitable material.

According to an exemplary embodiment, the toilet 10 includes a bowl 14 (e.g., a toilet bowl) configured to house water and waste, a rim channel 54 that is provided above the bowl 14, a water supply hole 44 that is fluidly connected to the rim channel 54, and a trapway 50 that is fluidly connected to the bowl 14. The water supply hole 44 is configured to receive a supply of water from a source and direct the water to the rim channel 54. The rim channel 54 directs the water into the bowl 14, such as through various openings in the rim channel 54. The water and waste are transferred from the bowl 14 and out of the toilet 10 through the trapway 50 during a flush cycle.

The toilet 10 may include a lid, a seat, both a lid and a seat, or other attachments pivotally coupled to the toilet 10. As shown in FIG. 1, the toilet 10 includes an attachment 70, such as a lid attachment, that is coupled to a top surface 18 (shown in FIG. 2) of the toilet 10. In other exemplary embodiments, the attachment 70 of the toilet 10 may alternatively or additionally include a seat attachment and/or a bidet attachment.

Figure 6:
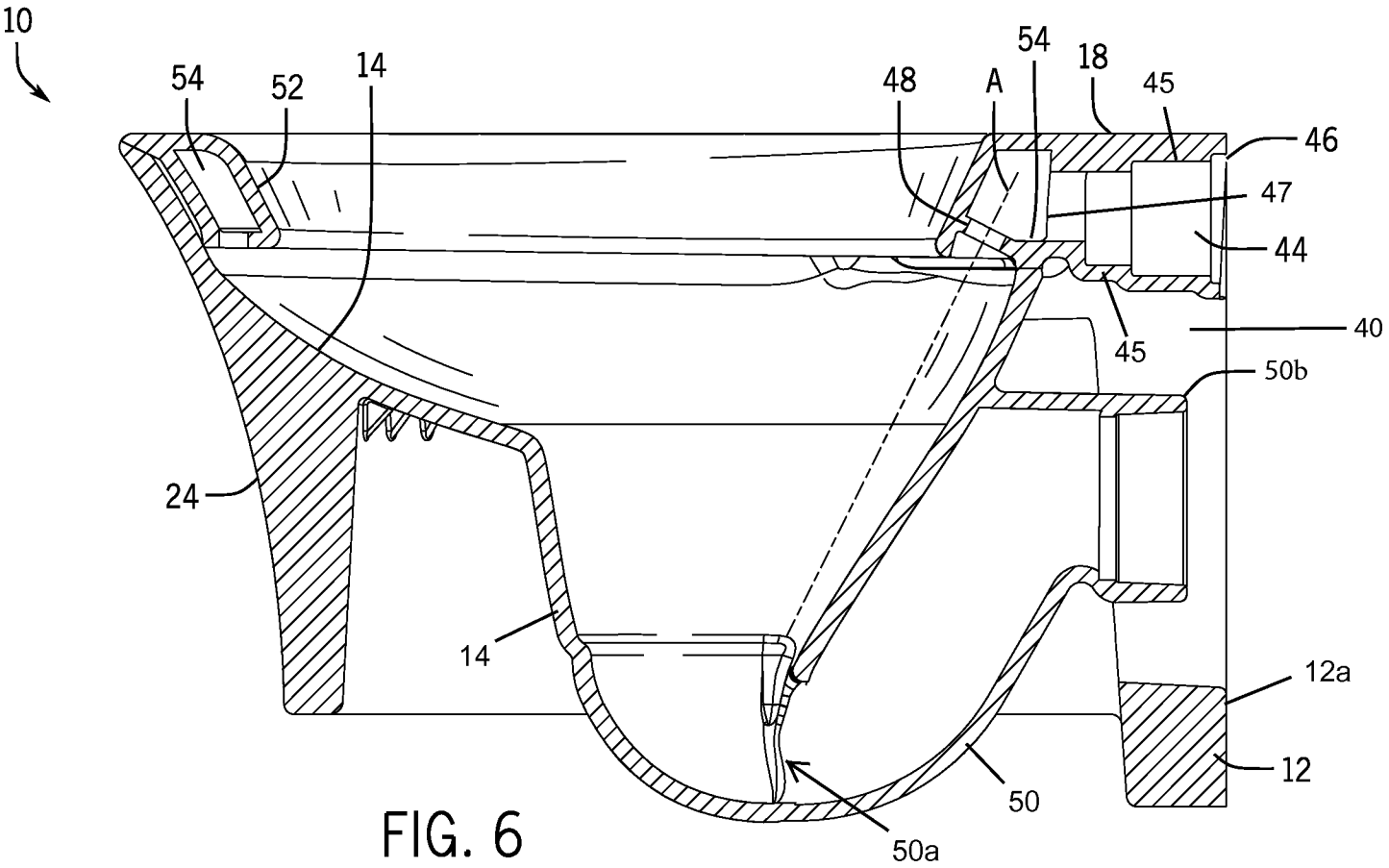
FIG. 6 is a cross-sectional view of the toilet shown in FIG. 3, taken along line 6-6.

The toilet 10 may include a shroud 24 that surrounds a portion of the toilet 10. As shown in FIG. 6, the shroud 24 surrounds at least a portion of the bowl 14. The shroud 24 may have a curved outer surface that is generally concave, and curves inwardly toward a bowl 14 of the toilet 10. The shroud 24 may be integrally formed with the bowl 14 proximate the top surface 18 of the toilet 10. The concavity of the shroud 24 may increase the amount of space in which a person may reach underneath a toilet, mop/sweep underneath a toilet, etc. The shroud 24 may also define the amount of clearance space between the toilet 10 and a floor when the toilet 10 is installed on a wall. Therefore, the shroud 24 may be configured to increase the amount of space available to clean underneath and around the toilet 10. The shroud 24 may have other suitable configurations (e.g., shapes, sizes, etc.). For example, the shroud may a convex curved outer surface. As another example, the shroud may have a generally flat outer surface.

Figure 3:
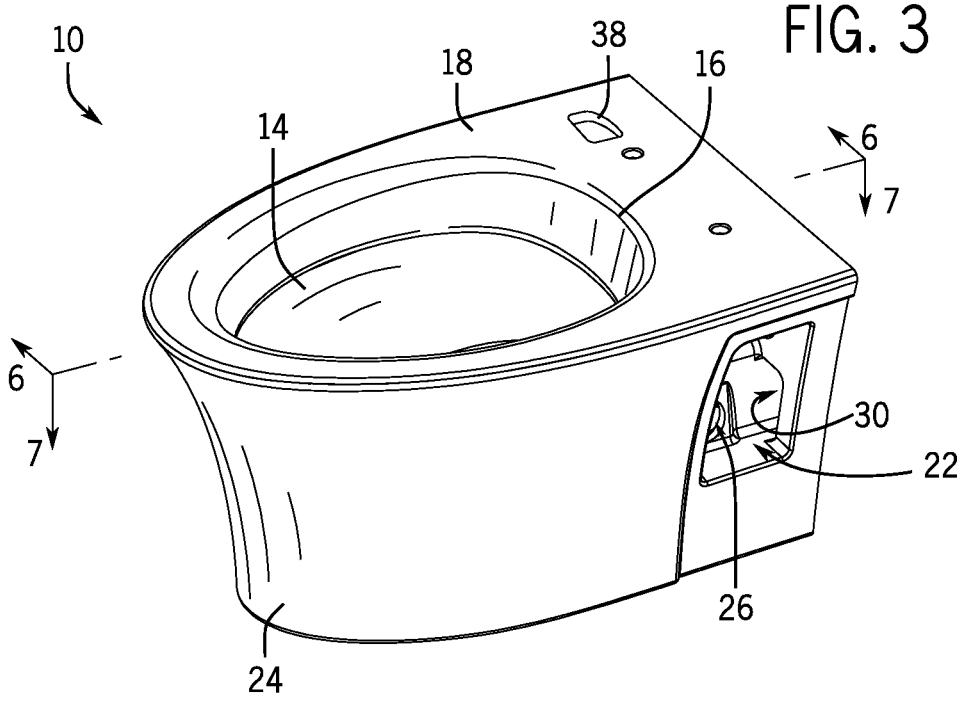
FIG. 3 is a perspective view of the toilet shown in FIG. 1 without the lid attachment.

The toilet 10 may include a pocket, such as a side pocket 22 provided in the shroud of the toilet. For example, the toilet 10 may include two side pockets 22, where one side pocket 22 may be disposed on each of a left side and a right side of the toilet 10. FIGS. 1-4 illustrate the left-side pocket 22, and the right-side pocket may be configured generally symmetrically opposite to the left-side pocket or may be configured differently than the left-side pocket 22. As viewed from either the left or the right side of the toilet 10, and as shown in FIG. 4, the side pockets 22 may be defined on a rear side by a rear mounting wall 12, and on a front side by a bowl 14 and/or the shroud 24. As shown in FIG. 3, the side pockets 22 may also be defined by an interior end side, which may separate the side pockets 22 from the bowl 14 and a trapway 50. It is noted that the pocket(s), such as the pocket 22, is optional on the toilet 10. Although, the toilet not having a pocket may require external routing of the features, such as the water line and/or electrical cord, which is not as advantageous as routing such features internally to the toilet, such as for aesthetics, cleanability, functionality, and other reasons. However, routing such features externally to the toilet may be easier for installation purposes.

Figure 5:
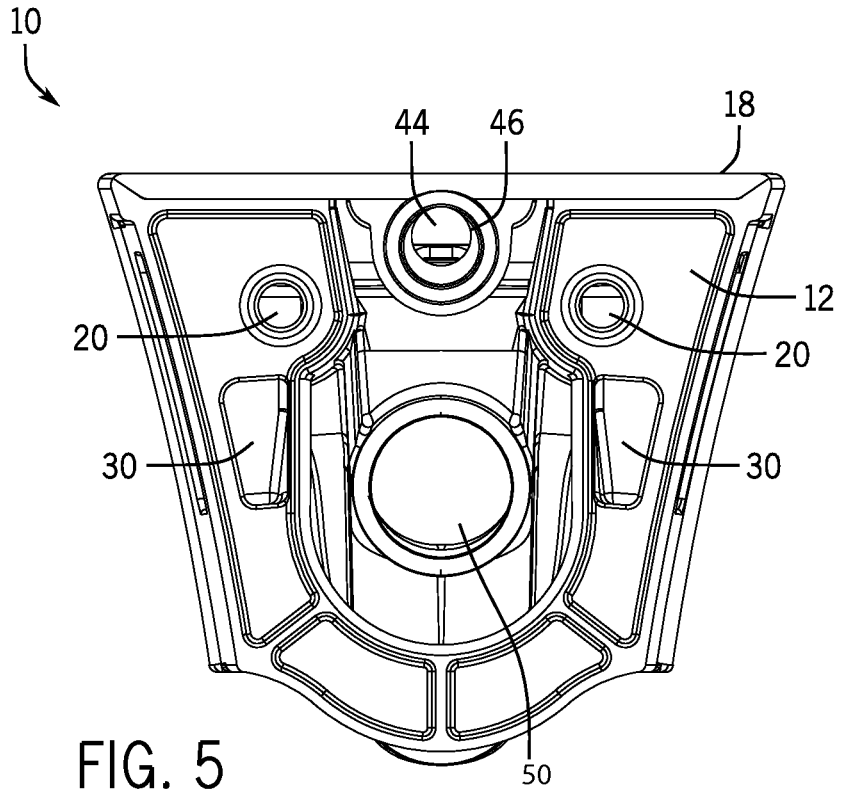
FIG. 5 is a rear plan view of the toilet shown in FIG. 3.

As shown in FIG. 4, the toilet 10 is installed on (e.g., mounted to) the wall 9. The toilet 10 may include one or more mounting holes 20 that are configured to facilitate mounting the toilet 10 to the wall 9, such as, using one or more fasteners and/or threaded stud bolts. As shown in FIG. 5, the toilet 10 includes two spaced-apart mounting holes 20 disposed in a mounting wall 12 of the toilet 10 in order to couple the mounting wall 12 (and the toilet 10) to the wall 9. The mounting holes 20 may be defined on one side by either of the side pockets 22. The mounting holes 20 may be disposed proximate to a top portion of the mounting wall 12, such as with one mounting hole 20 on a left side of the mounting wall 12 and with another mounting hole 20 on a right side of the mounting wall 12.

According to other embodiments, the mounting holes of the toilet may be arranged within a mounting wall in a variety of ways that are configured to provide sufficient support for the toilet when the toilet is installed on a wall. For example, the mounting holes may be centered between left and right sides of the toilet proximate a bottom and top of a mounting wall. Also, the mounting holes may be provided on left and right sides of the toilet proximate a bottom portion of the mounting wall. Further, the mounting holes may be arranged as a combination of any of the previously described arrangements.

The toilet 10 may be coupled to a wall (e.g., the wall 9) when the mounting holes 20 are received, for example, by threaded stud bolts, which may extend into each side pocket 22. For example, the threaded stud bolts may be coupled to the wall and extend through the mounting holes 20 of the mounting wall 12 into the side pockets 22, whereby additional fasteners are used within each side pocket to fasten to the bolts to secure the toilet 10 to the wall. Fasteners may then be used on the threaded stud bolts within each side pocket 22 to fasten the toilet to the wall. According to an exemplary embodiment, the side pockets 22 may be configured to enable a user to more easily install the toilet 10 to the wall 9. For example, the height and width of an opening of the side pockets 22 may be sufficiently large for a human hand to be received therein, in order for a person to easily access the fastener in the pocket 22 to couple the toilet 10 to a wall using the fastener. Therefore, the side pockets 22 may be configured to receive a human hand in order to facilitate the installation of the toilet 10 onto a wall.

Figure 2:
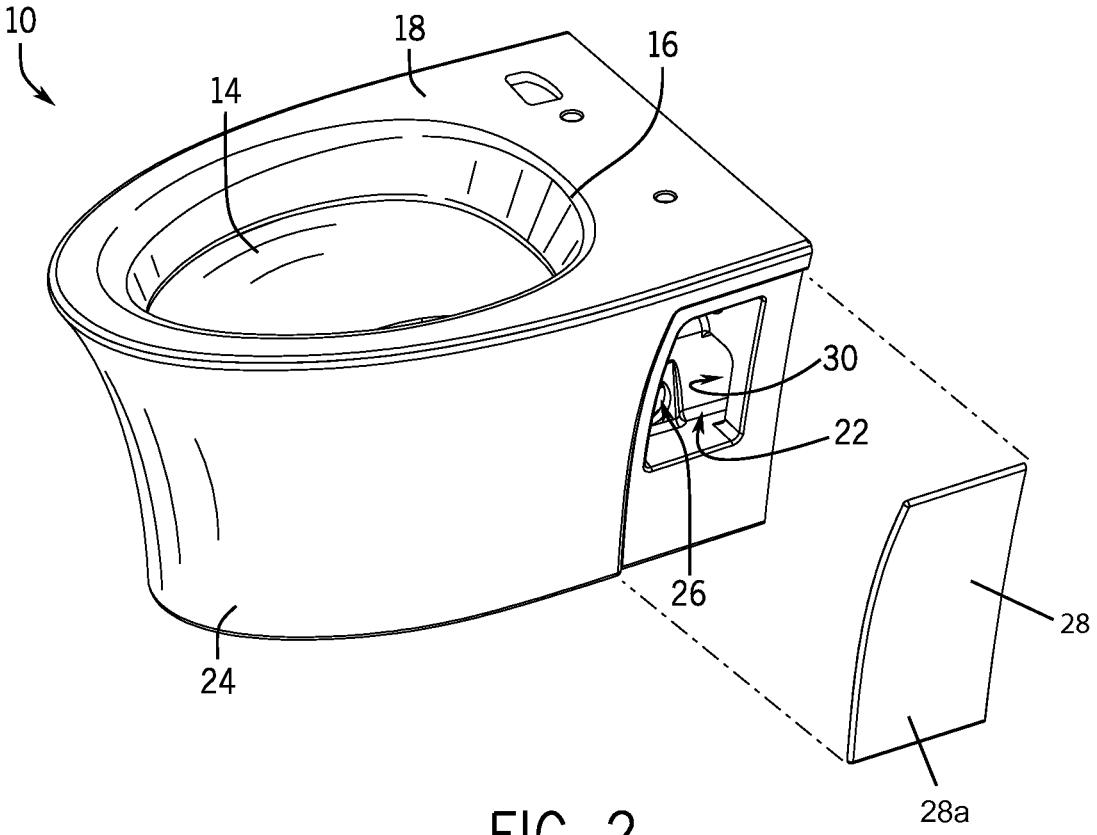
FIG. 2 is an exploded perspective view of a toilet with a removable cover for a side pocket, according to an exemplary embodiment.

The toilet 10 may include a cover that is configured to cover the side pockets 22. As shown in FIG. 2, a removable cover 28 may be detachably coupled to the toilet 10, such as one of the side pockets 22, in order to cover the respective side pocket. Each side pocket 22 of the toilet 10 may be covered by a removable cover 28 in order to advantageously improve the aesthetics of the toilet when covering the pocket while providing the utility of access to the pocket when removed from covering the pocket. For example, the outer surface of each side pocket 22 may be recessed relative to the shroud 24, such that when the removable cover 28 is coupled to the toilet 10, an exterior (e.g., outer) surface **28*a* of each removable cover 28 is flush with the shroud 24. In turn, the exterior surface of each removable cover 28 may be configured to complement an exterior surface of the shroud 24, such as the curvature of the shroud 24 when each removable cover 28 is coupled to the toilet 10 covering the respective side pocket 22**.

According to an exemplary embodiment, each removable cover 28 may be removably coupled to a side pocket 22. For example, an inner side of each removable cover 28 may include a plurality of flexible clips, which may be configured to removably couple to a plurality of sides of the respective side pocket 22. Also, for example, a fastener, such as hook and loop fastener tape, may be used on each of an inner surface of the removable covers 28 and the outer surface of the side pockets 22 to detachably couple the cover 28 to the side pocket 22. It should be understood that the removable covers 28 may be coupled to the side pockets 22 of the toilet 10 in other suitable ways.

According to another exemplary embodiment, each side pocket 22 of the toilet 10 may include a cover that is hinged on one side. The hinged side of the cover may be coupled to a side of the toilet, and the cover may pivot between closed and open positions, such as to conceal or provide access to the side pocket 22.

Advantageously, the removable covers 28 may conceal the side pockets 22, as well as any fasteners used to install the toilet 10 to a wall, from view. Further, the removable covers 28 may advantageously prevent the side pockets 22 from accumulating dirt and other contaminants. Thus, toilet 10 may be easier to clean and maintain with the covers 28 in place.

As shown in FIG. 3, the bowl 14 of the toilet 10 is positioned forward of the side pockets 22 and the mounting wall 12 (see, e.g., FIG. 4) when the toilet 10 is installed on a wall. The bowl 14 may define an opening 16 within the top surface 18. As shown in FIG. 3, the bowl 14 and the opening 16 may be generally oval-shaped. In other embodiments, the bowl 14 and the opening 16 may be generally circular, elongated, or have any other suitable shape.

As shown in FIG. 4, the toilet 10 includes a side pocket hole 26 that is disposed within the inner side of each side pocket 22. Each side pocket hole 26 may extend from the respective side pocket 22 on a first side to a space (the space is between the bowl 14 and the mounting wall 12) on a second side. The side pocket hole 26 may be configured to receive either of an electrical cord, a water supply line, both an electrical cord and a water supply line, or any other suitable cord/line/hose for a toilet attachment or accessory. As shown in FIG. 4, the side pocket hole 26 is a generally circular hole. According to other exemplary embodiments, the shape of the side pocket hole 26 may be oval, rectangular, or any other suitable shape, which may, for example, allow routing of another element (e.g., electrical cord, water line, etc.) through the side pocket hole 26 of the toilet 10.

As shown in FIGS. 4-6, the mounting wall 12 of the toilet 10 is located rearward of the side pockets 22 and the bowl 14. Also, the mounting wall 12 may be integrally formed with the bowl 14 and the side pockets 22. The mounting wall 12 may include a rear surface 12*a* that is generally planar. The rear surface 12*a* of the mounting wall 12 is configured to face a wall when the toilet 10 is installed thereon.

The toilet may include additional holes. As shown in FIG. 5, in addition to the mounting holes 20, a clearance hole 30 is disposed within a portion of each of the left and right sides of the mounting wall 12. According to an exemplary embodiment, the clearance holes 30 are also disposed within the rear side of each side pocket 22. As shown in FIG. 5, each clearance hole 30 is positioned below either of the mounting holes 20, and each clearance hole 30 is elongated vertically. According to other embodiments, the clearance holes may be positioned above the mounting holes 20, or on another side relative to the mounting holes 20. Further, the present disclosure is not intended to limit the size, shape, or geometry of the clearance holes 30. In addition, each clearance hole 30 is configured to receive an electrical cord, a water supply line, both an electrical cord and a water supply line, or any other suitable cord/line/hose for a toilet attachment or accessory.

The toilet 10 may include a trapway 50 to transfer water and waste from the bowl 14 and out of the toilet 10. As shown in FIGS. 5 and 6, the trapway 50 is provided on the rear side of the bowl 14, and includes an inlet 50*a* and an outlet 50*b*. The inlet 50*a* of the trapway 50 is fluidly connected to the bowl 14 and the outlet 50*b* extends through a portion of the rear mounting wall 12. The trapway 50 may be centered horizontally between a left and right side of the toilet 10, such as between the clearance holes 30. The trapway 50 may be positioned vertically above a lower portion 12*b* of the mounting wall 12 and below a water supply hole 44. The outlet 50*b* of the trapway 50 is configured to be coupled to a drain pipe (i.e., a sewer pipe which is not shown) in order to evacuate water and waste from the bowl 14 into the drain pipe.

FIGS. 5 and 6 also illustrate an exemplary embodiment of the water supply hole 44 that is provided near a top portion, such as the top surface 18, of the toilet 10. The water supply hole 44 may be configured to be coupled to a supply line (not shown) that supplies water to the toilet 10. The supply line may be provided, for example, within the wall that the toilet 10 may be installed to. The toilet 10 may include a flush valve configured to regulate the amount of water that is provided by the supply line to the water supply hole 44 for a flushing cycle. For example, an in-wall tank may be positioned within the wall, and a flush valve may be used to control the amount of water that is supplied by the tank to the water supply hole 44. As another example, a flush valve may be configured to be coupled directly between a water supply and the water supply hole 44. Such a flush valve may regulate the amount of water provided to the water supply hole 44 during a flushing cycle. It should be understood that other devices may be used to provide water to the water supply hole 44 of the toilet 10. For example, the tank may be external to the wall to which the toilet 10 is attached. The tank may also be internal or external to the toilet, as well as the wall to which the toilet 10 is attached.

As shown in FIG. 6, the water supply hole 44 may be defined at a first end by a rear opening 46, and at a second end by an opening 47 within the rim channel 54. The rear opening 46 of the water supply hole 44 may be generally co-planar with the mounting wall 12, and the second end positioned near a rearward portion of the bowl 14, within the rim channel 54. As shown in FIG. 6, there are a plurality of steps 45 along the length of the water supply hole 44, and the diameter of each step decreases from the rear opening 46 to the rim channel 54. According to other exemplary embodiments, the water supply hole 44 may be configured to decrease in diameter from the rear opening 46 to the rim channel 54 (e.g., the water supply hole may be tapered, etc.). The reduction in diameter of the water supply hole 44 may advantageously increase the water pressure of water flowing therethrough, thereby increasing the kinetic energy of water flowing therethrough. This arrangement may improve cleaning the bowl by increasing the pressure of the water delivered to the bowl, such as from the rim channel.

Figure 7:
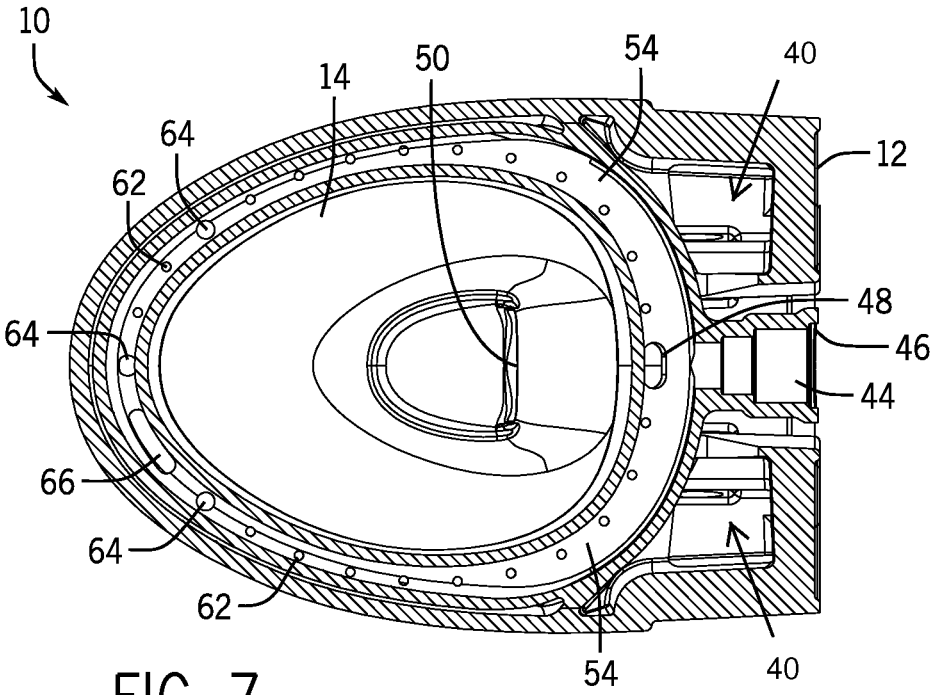
FIG. 7 is a cross-sectional view of the toilet shown in FIG. 3, taken along line 7-7.

As shown in FIGS. 6-7, according to an exemplary embodiment, an angled slot 48 is disposed within a rear portion of the rim channel 54. An axis "A" may be defined by the bore of the angled slot 48, and as shown in FIG. 6, where the axis A is generally directed toward an entry for the trapway 50. According to an exemplary embodiment, the angled slot 48 is configured to dispense water toward the inlet 50*a* of the trapway 50.

The arrangement of the angled slot 48 and the rim channel 54 may advantageously be configured to conserve the hydraulic power of water that is supplied to the rim channel 54 by the water supply hole 44. For example, the angled slot 48 is configured so that water pressure and gravity complementarily act on water dispensed therefrom (i.e., water pressure acts in a first direction parallel to the axis A and gravity acts in the vertical portion of the first direction). When water pressure and gravity complementarily act on water that is dispensed through a hole, hydraulic power is conserved. In contrast, when water pressure and gravity do not complementarily act on water dispensed through a water, energy is lost as gravity alters the direction of the water dispensed (i.e., from an essentially horizontal direction to an essentially vertical direction). When the hydraulic power of water supplied to the bowl 14 and the trapway 50 is conserved, there is more available energy that may be used to evacuate the bowl 14 and the trapway 50. As the amount of energy that is available to evacuate the bowl 14 and the trapway 50 increases, the effectiveness of the flushing cycle increases. Therefore, in contrast to a rim hole for a toilet that dispenses water in a generally horizontal direction, the angled slot 48 is configured to more effectively evacuate waste from the bowl 14 and the trapway 50.

According to various exemplary embodiments, an angle of the axis A, relative to a vertically downward direction, may be between approximately 15° and 60° (i.e., fifteen to sixty degrees) when the toilet 10 is operably mounted. More preferably, the angle of the axis A, relative to a vertically downward direction, may be between approximately 20° and 50° (i.e., twenty to fifty degrees) when the toilet 10 is operably mounted. Even more preferably, the angle of the axis A, relative to a vertically downward direction, may be approximately 25° (i.e., twenty-five degrees) when the toilet 10 is operably mounted.

As shown in cross-section of FIG. 7, according to an exemplary embodiment, the angled slot 48 may be generally oval-shaped that is elongated in a side-to-side direction. According to other exemplary embodiments, the cross-section of the angled slot 48 may be circular, rectangular, elongated in a fore-and-aft direction, or any other suitable shape. The cross-section of the angled slot 48 may be smaller in surface area than the cross-section of the rear opening 46. This arrangement may advantageously increase the water flow (e.g., velocity, pressure).

As shown in FIG. 7, the toilet 10 includes a rim channel 54, which is positioned along an upper portion of the bowl 14, and extends along the perimeter of the bowl 14. The rim channel 54 is fluidly coupled to the water supply hole 44, and as shown in FIG. 7, branches off to the left and right from the front opening (e.g., the opening 47) of the water supply hole 44. The rim channel may be fluidly coupled to a separate water supply from the water supply that supplies the slot 48. The rim channel 54 is configured to channel (e.g., direct) water from the water supply hole 44 to a plurality of rim holes 62, 64, which are disposed around the rim channel 54. The rim holes 62, 64 may be disposed in a linear lower surface of the rim channel 54.

According to an exemplary embodiment, the plurality of rim holes 62, 64 includes holes of different sizes. The different sized holes may be disposed within the rim channel 54 in, for example, an alternating arrangement (e.g., an arrangement in which smaller diameter holes, such as the rim holes 62, alternate with larger diameter holes, such as the rim holes 64). The alternating arrangement of rim holes 62, 64 may advantageously generate a swirling effect (e.g., a cyclone effect, vortex effect, etc.) of water along the surface of the bowl 14, when water flows therethrough. As shown in FIG. 7, the plurality of rim holes may include several larger holes 64 with the remaining holes being smaller holes 62.

The rim channel 54 of the toilet 10 may include a rim slot 66. The rim slot 66 may be disposed within the bottom surface of the rim channel 54 (see FIG. 7), proximate a front-left portion of the rim channel 54. The length of the rim slot 66 is greater along the length of the rim channel 54 than the width of the rim channel 54. As shown, the rim slot 66 may be larger than the other rim holes 62, 64. According to another exemplary embodiment, the rim slot 66 may be disposed on a front-right portion of the rim channel 54. Further, the rim slot 66 may advantageously help generate a swirling effect of water along the surface of the bowl 14, when water flows through the rim slot 66. For example, the combination of the alternating arrangement of rim holes 62, 64 and the rim slot 66 may be configured to generate a swirling effect of water along the surface of the bowl 14, when water flows through the rim channel 54. It should be understood that other arrangements of alternating holes (i.e., a specific number of alternating holes, the relative and specific size of alternating holes, etc.) may be used to tailor the swirling effect of water along the surface of the bowl 14 of the toilet 10.

By way of example, rim channels having a series of rim holes, such as the rim holes 62, 64 and the rim slot 66, may generate a swirling effect of the water, which may clean a greater amount of the bowl 14 compared to toilets having rim holes that are not configured to generate a swirling effect of the water. For example, water that follows a pathway defined by a "swirling" pattern may cover more surface area of the bowl 14 than water that follows a pathway that is more direct from a rim hole of the rim channel. Water that covers more surface area of the bowl 14 may clean more waste off the surface of the bowl 14. Therefore, an arrangement of rim holes 62, 64 and/or a rim slot 66 that are configured to generate a swirling pattern of water across the bowl 14 may clean more waste off the bowl 14 than a series of rim holes that are not configured to generate a swirling effect of water.

Figure 8:
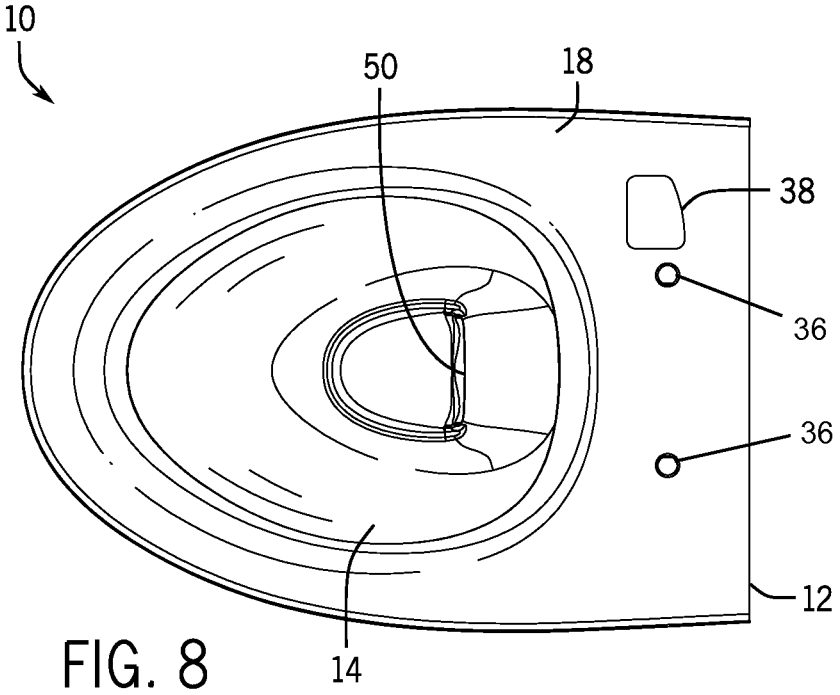
FIG. 8 is a top plan view of the toilet shown in FIG. 3.

The toilet 10 may include one or more holes configured to facilitate mounting a toilet attachment (e.g., a seat attachment, lid attachment, and/or bidet attachment) to the toilet 10. FIG. 8 illustrates a pair of spaced apart holes 36, which may be used to mount a toilet attachment, such as the attachment 70. Each hole 36 may be disposed within the top surface 18 of the toilet 10, such that the toilet attachment may be coupled to the top surface 18 using a variety of fasteners. The fasteners may extend into either of the side pockets 22, such as to provide a user with access to the fasteners, where the removable covers 28, if provided, may conceal the fasteners used to couple the toilet attachment to the top surface 18 of the toilet 10.

FIG. 8 also illustrates an accessory hole 38 that is disposed within the top surface 18 of the toilet 10. The accessory hole 38 extends from the top surface 18 on a first side to the space 40 within the vitreous (the space 40 is best illustrated, for example, in FIG. 6) on a second side. As shown, the space 40 is defined on a rear side by the mounting wall 12, on a front side by the bowl 14, and on left and right sides by the side pockets 22. The trapway pipe 50 may also be positioned within the space 40. As shown in FIG. 8, the shape of the accessory hole 38 is oblong. However, it should be understood that the accessory hole 38 or other accessory holes may take on a variety of shapes and sizes.

The accessory hole 38 may be configured to receive an electrical cord and/or a supply line. For example, a bidet attachment for the toilet 10 may typically include an electrical cord and a supply line. The bidet attachment may be coupled to the top surface 18 of the toilet 10, such as using holes 36, and the electrical cord and/or the supply line of the bidet attachment may be routed through the accessory hole 38. Thus, electric power and/or water may be routed from a source through the toilet 10, such as the space 40 and the accessory hole 38, to the bidet attachment. The accessory hole 38 may be positioned within the top surface 18 at a location that may be substantially below or adjacent to a location where the electrical cord and supply line are coupled to the bidet attachment, when the bidet attachment is coupled to the toilet 10. This arrangement may advantageously allow routing of the electric power and water to the bidet attachment with the electrical cord and supply line hidden from view, such as from a user.

According to an exemplary embodiment, the toilet 10 is configured to substantially contain (i.e., house, receive, hold, envelope, etc.) the electrical cord and supply line of the bidet attachment, so that the electrical cord and supply line are minimally disposed along an exterior surface of the toilet 10. In other words, according to an exemplary embodiment, it is desired to minimize the presence of the electrical cord and supply line of the bidet attachment outside the toilet 10 when the bidet attachment is coupled thereto. To this end, the electrical cord and supply line of the bidet attachment may be received within the accessory hole 38 and extend into the space 40 when the bidet attachment is coupled to the toilet 10. Then, the electrical line and supply line may each be routed within the space 40 to either of the side pocket holes 26 of the respective side pockets 22. The electrical line and supply line may each be received by either of the side pocket holes 26, and extend into the corresponding side pocket 22.

The electrical power supply and the water supply may be provided, for example, within the wall 9 to which the toilet 10 is mounted to (e.g., installed on). The electrical power supply and the water supply may also be configured to extend into either of the side pockets 22, after having been extended through the wall and received by either of the clearance holes 30. Accordingly, the electrical cord from the bidet attachment may be electrically coupled to an electrical power supply within a first side pocket 22, and the supply line may be fluidly coupled to a water supply within a second side pocket 22. In this way, the electrical cord and supply line of the bidet attachment are substantially contained within an exterior surface of the toilet 10. In other words, the electrical cord and/or the supply line may be partially or completely hidden from view of a user of the toilet 10.

According to another exemplary embodiment, the electrical power supply and the water supply are each coupled to the bidet attachment on opposite sides of the toilet 10. For example, the water supply may be introduced into the toilet 10 through one of the clearance holes 30 and routed to the bidet attachment through the accessory hole 38; and the electrical power supply may be introduced into the toilet 10 through another clearance hole 30 and routed to the bidet attachment through a second accessory hole. The toilet 10 may include a valve to regulate the flow of water, such as to the bowl and/or to a bidet attachment. For example, the portion of the water supply line that is received within the side pocket 22 may include a valve to regulate the flow of water that is dispensed therethrough.

Advantageously, an electrical cord and a water supply line used with a toilet attachment or a toilet accessory may be self-contained so that these elements are not substantially positioned along the exterior of a toilet. Accordingly, the electrical cord and a water supply line are kept out of the way so as not to interfere with cleaning around the toilet. Also, the toilet disclosed in the various exemplary embodiments herein may protect pets that are prone to chew on electrical cords. Also, the toilet disclosed in the various exemplary embodiments herein prevents an electrical cord and a water supply line of a bidet attachment from accumulating dust, urine, and other contaminants. The toilets disclosed herein may also have an improved aesthetics, since the cords and lines are hidden from view.

In another exemplary embodiment, a bidet attachment for a wall-hung toilet may overhang at least one side of the top surface of the toilet. According to this embodiment, an accessory hole may be disposed near the upper side of the toilet, proximate where the bidet attachment overhangs the side of the toilet. In this way, the electrical cord and supply line of the bidet attachment may be routed through the accessory hole, a space within the vitreous, and either of two side pocket holes to be received by either of two side pockets of the toilet. Accordingly, an electrical power supply and a water supply may be configured to extend into the through the mounting wall, either of two clearance holes, and into either of the two side pockets where they may be coupled to the electrical cord and supply line of the bidet attachment.

According to another exemplary embodiment, the electrical cord and water supply line of a bidet attachment may be routed through a single rim hole, and couple to an electrical power supply and a water supply within a single side pocket of the toilet.

According to yet another exemplary embodiment, a wall-hung toilet may have a side pocket on left and right sides of the toilet. According to this embodiment, each side pocket may have an inner side that is not defined by an inner wall or an inner surface (i.e., the inner side of the side pocket is openly disposed). An extension cord or a water supply line of a bidet attachment may be extend through an accessory hole disposed within a top surface of the toilet, and into a space between the mounting wall and the bowl. Then, the electrical cord may be routed through the space and be received by either side pocket (the inner side of the side pocket being openly disposed to the space). An electrical power supply and a water supply may be provided in a wall, and extend through the wall. The electrical power supply and water supply may extend through either of a clearance hole disposed within the mounting wall and into the respective side pocket. Therefore, the extension cord and water supply line of the bidet attachment may couple to the electrical power supply and water supply, respectively, within the side pocket.

According to various embodiments of this disclosure, other electrical cords and fluid conduits may be received by an accessory hole disposed within a top surface of a toilet. For example, an electrical cord for a heated seat attachment, an illuminated seat attachment/lid attachment, or an electric motor configured to raise and lower a seat attachment/lid attachment, etc. may be received by an accessory hole.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the toilet as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A wall-hung toilet mountable to a fixture wall, comprising:

a bowl;

a water inlet chamber configured to receive a supply of water;

a rim channel provided above the bowl and fluidly connected to the water inlet chamber to receive the supply of water;

a shroud comprising:

a top wall having an opening;

a rear wall having a mounting hole that is configured to connect the toilet to the fixture wall via a fastener;

an outer side wall extending downwardly from the top wall to define a first portion of a bottom edge of the shroud and surrounding at least a portion the bowl; and an inner side wall coupled to the outer side and rear walls, wherein the inner side wall is recessed inwardly from the outer side wall, and the recessed portion of the inner side wall defines at least a portion of a rearward edge of the shroud and a second portion of the bottom edge, and includes an opening;

wherein the outer and inner side walls define a pocket; and a passage located within the shroud that extends between the opening in the top wall, the opening in the inner side wall, and the mounting hole in the rear wall.

2. The wall-hung toilet of claim 1, further comprising a removable cover that is configured to directly couple to the inner side wall to cover the pocket, wherein an exterior surface of the removable cover complements an exterior surface of the outer side wall, such that the removable cover appears as a continuation of the outer side wall.

3. The wall-hung toilet of claim 1, wherein the rim channel includes an opening that is configured to introduce water into a rear portion of the bowl at an angle relative to vertical, and the opening in the rim channel is a slot that is elongated in a side to side direction of the toilet and is provided in a rear portion of a lower member of the rim channel that is adjacent to the water inlet chamber.

4. The wall-hung toilet of claim 3, wherein the lower member of the rim channel is aligned at an angle that is perpendicular to the angle that the water is introduced into the bowl at.

5. The wall-hung toilet of claim 4, wherein the rim channel further includes a plurality of rim holes in addition to the opening, wherein the plurality of rim holes are disposed around the rim channel in a spaced-apart manner and include rim holes having different sizes, and wherein the spacing and the sizing of the rim holes is configured to swirl the water around the bowl during a flush cycle of the toilet.

6. The wall-hung toilet of claim 1, wherein the rear wall further includes a clearance hole that extends into the passage to allow routing of at least one of a water line and an electrical cord into the passage of the toilet through the clearance hole.

7. The wall-hung toilet of claim 6, wherein the opening in the top wall extends downwardly into the passage to allow routing of at least one of a water line and an electrical cord out through the passage.

8. The wall-hung toilet of claim 7, wherein the opening in the top wall is provided between the rear wall and the bowl.

9. A wall-hung toilet, comprising:

a bowl;

a shroud surrounding at least a portion of the bowl;

a rear mount including a mounting hole and a clearance hole, wherein the mounting hole is configured to connect the toilet to a wall via a fastener configured to engage the wall and the mounting hole in the rear mount and the clearance hole is configured to allow routing of a water line and an electrical cord to the toilet through the clearance hole;

a recessed pocket formed in a side of the toilet between the rear mount and the bowl, the recessed pocket defining at least a portion of each of a rearward edge and a bottom edge of the shroud; and an accessory hole provided in a top surface of the toilet, wherein the accessory hole extends downwardly into the recessed pocket to allow routing of the water line and the electrical cord;

wherein the recessed pocket provides access to an interior side of the mounting hole and an interior side of the clearance hole from the side of the toilet, such that the fastener, the water line, and the electrical cord can be accessed through the recessed pocket from the side of the toilet.

10. The wall-hung toilet of claim 9, further comprising a water inlet chamber that tapers from an inlet to a rim channel to increase water pressure of water flowing to the rim channel and into the bowl.

11. The wall-hung toilet of claim 9, wherein the rear mount further includes a second mounting hole configured to connect the toilet to a wall via a second fastener configured to engage the wall and the second mounting hole, and wherein the two mounting holes are provided on opposing sides of an outlet of a trapway and a water supply hole.

12. The wall-hung toilet of claim 11, wherein the recessed pocket is a first recessed pocket, further comprising a second recessed pocket formed in a second side of the toilet that is opposite the first recessed pocket, wherein the second recessed pocket provides access to an interior side of the second mounting hole, such that the second fastener can be accessed through the second recessed pocket from the second side of the toilet.

13. The wall-hung toilet of claim 12, wherein the rear mount further includes a second clearance hole configured to allow routing of the other of the water line and the electrical cord into the second recessed pocket of the toilet through the second clearance hole.

14. The wall-hung toilet of claim 13, further comprising an attachment hole, wherein the accessory hole is located between the attachment hole and the side.

15. The wall-hung toilet of claim 14, further comprising a water inlet chamber having at least three steps that decrease in diameter from an inlet to a rim channel, wherein the accessory hole is provided in the top surface of the toilet between a rear surface of the rear mount and the bowl.

16. A wall-hung toilet, comprising:

an upper wall having a top surface and an opening;

a bowl extending downwardly from the upper wall;

a shroud extending downwardly from the upper wall to define a first portion of a bottom and surrounding at least a portion of the bowl;

a rear mounting wall having a mounting hole and a clearance hole;

a first side wall coupled to a rear edge of the shroud and the rear mounting wall, wherein the first side wall extends downwardly to a second portion of the bottom, includes an opening, and is recessed inwardly relative to an outer surface of the shroud to define a first pocket between the rear edge of the shroud and the rear mounting wall;

a second side wall coupled to the rear edge and the rear mounting wall on an opposite side from the first side wall, the second side wall includes an opening and is recessed inwardly relative to the shroud to define a second pocket between the rear edge and the rear mounting wall; and an internal compartment within the shroud and extending between the opening in the upper wall, the opening in the first side wall, the opening in the second side wall, and at least one of the mounting hole and the clearance hole;

wherein a first side pocket hole of the first pocket extends through the internal compartment to a second side pocket hole of the second pocket.

17. The wall-hung toilet of claim 16, wherein the rear mounting wall includes a second mounting hole that extends through the rear mounting wall and into the second pocket; and wherein the internal compartment further extends between the opening in the second side wall and the second mounting hole.

18. The wall-hung toilet of claim 17, wherein the rear mounting wall further includes a second clearance hole that extends through the rear mounting wall into the internal compartment and is provided on an opposite side of a water supply hole and an outlet of a trapway compared to the first clearance hole.

19. The wall-hung toilet of claim 16, further comprising a rim channel disposed between the top surface and the bowl, the rim channel including an opening that is configured to introduce water into a rear portion of the bowl at an angle relative to vertical.

20. The wall-hung toilet of claim 19, further comprising a water inlet hole that receives a supply of water from a source and directs the water to the rim channel, wherein the water inlet hole is defined by at least two stepped sections, and wherein the at least two stepped sections have decreasing diameters moving from a rear opening to the rim channel.

* * * * *